United States Patent [19]

Kronseder

[11] Patent Number: 4,795,525

[45] Date of Patent: Jan. 3, 1989

[54] LEVER-ACTUATED COMPOUND SLIDE SUPPORT FOR A LABELING MACHINE

[75] Inventor: Hermann Kronseder, Wörth, Fed. Rep. of Germany

[73] Assignee: Krones AG Hermann Kronseder Mashinenfabrik, Neutraubling, Fed. Rep. of Germany

[21] Appl. No.: 33,014

[22] Filed: Mar. 31, 1987

[30] Foreign Application Priority Data

Apr. 5, 1986 [DE] Fed. Rep. of Germany ... 8609267[U]
Feb. 27, 1987 [DE] Fed. Rep. of Germany ... 8703016[U]

[51] Int. Cl.[4] ..... B65C 9/08; B65C 9/30

[52] U.S. Cl. ..... 156/567; 74/104; 156/568; 156/DIG. 28; 156/DIG. 39; 248/657; 248/658; 248/661

[58] Field of Search ..... 248/646, 651, 657, 658, 248/661, 660, 668; 156/364, 567, 568, DIG. 25, DIG. 28, DIG. 39; 74/104, 102, 526, 568 R

[56] References Cited

U.S. PATENT DOCUMENTS

| | | | |
|---|---|---|---|
| 407,257 | 7/1889 | Sergeant | 248/646 |
| 863,545 | 8/1907 | Maclachlan | 74/568 |
| 975,589 | 11/1910 | Watkins | 74/568 |
| 1,580,499 | 4/1926 | Kruttschnitt | 74/104 |
| 1,686,993 | 10/1928 | Suter | 248/646 |
| 2,024,127 | 12/1935 | Coppock | 248/662 |
| 2,089,381 | 8/1937 | Kassing | 248/657 |
| 2,282,699 | 5/1942 | Black | 248/662 |
| 2,301,230 | 11/1942 | Smith | 248/661 |
| 4,098,056 | 7/1978 | Ozaki | 53/212 |
| 4,594,123 | 6/1986 | Eder | 156/568 |
| 4,625,596 | 12/1986 | Makus | 81/9.44 |

FOREIGN PATENT DOCUMENTS

| | | |
|---|---|---|
| 1277579 | 12/1961 | France . |
| 2421895 | 11/1975 | Fed. Rep. of Germany . |

OTHER PUBLICATIONS

Brown, *Five Hundred & Seven Machine Movements*, Brown & Seward, N.Y., N.Y., p. 28.

*Primary Examiner*—Michael Wityshyn
*Attorney, Agent, or Firm*—Fuller, Puerner & Hohenfeldt

[57] ABSTRACT

The invention relates to a labeling machine for receptacles comprising a labeling unit which is disposed on a compound slide comprising an upper carriage part and a lower carriage part. The upper carriage part is connected with parallel rods which extend through slide bushings on the lower carriage part. The upper carriage part is linked to a pivotable lever being limited in its pivoting path by an adjustable stop.

2 Claims, 4 Drawing Sheets

LEVER-ACTUATED COMPOUND SLIDE SUPPORT FOR A LABELING MACHINE

BACKGROUND OF THE INVENTION

The invention relates to a labeling machine for receptacles such as bottles comprising a labeling unit which is disposed on a compound slide having an upper carriage part and a lower carriage part.

Modern labeling machines are suited to process a variety of different shapes and sizes of receptacles. However, in the case of the change-over from one type of receptacle to another one, an exchange of machine parts for the substitute receptacles may be necessary. For example, the gripper cylinder often needs to be exchanged when the machine is converted to handle a different receptacle. For the exchange of the gripper cylinder and the possibly necessary readjustment of the labeling unit for other receptacle diameters the labeling unit must be mounted displaceably at least transversely to the running direction of the receptacle transporting device.

Therefore, according to prior art practice the labeling unit has been mounted on a compound slide which comprises an upper carriage part and a lower carriage part. These parts can be displaced relative to each other by means of a lead screw. This is done by means of a handwheel or crank which requires relatively long downtime due to the low thread pitch, which is necessary for reasons of self-locking. Also, the complicated adjustment of the position of the labeling unit relative to measuring scales or markings contributes partly to the delay.

SUMMARY OF THE INVENTION

The invention simplifies the change-over of a labeling unit to another receptacle diameter and reduces the downtime required for making a change-over.

This problem is solved with a labeling machine of the type mentioned at the beginning by, in the improved labeling unit described herein, connecting the upper part of the carriage with parallel rods, which extend through slide bushings at the lower part of the carriage and that the upper part of the carriage is linked to a pivotable lever limited in its pivoting path by an adjustable stop.

Due to the fact that the upper part of the carriage is connected with parallel rods which extend through slide bushings on the lower part of the carriage, a sliding mounting of the labeling unit is provided. The labeling unit thus can simply be displaced slidingly in the direction of the rods and therefore be adapted in this direction in its position to the correspondingly changed receptacle diameter. Because the upper part of the carriage is linked to a pivotable lever, adjustment can be carried out rapidly, simply and without great exertion. Due to the fact that an adjustable stop is provided which limits the pivoting path of the pivotable lever, the pivotable lever is only pivoted during adjustment until the lever meets the selected stop. The various adjustment positions of the stop correspond to different receptacle diameters. When the stop acts, that is, when the pivotable lever cannot be pivoted any further, the desired positioning of the labeling unit is automatically ensured.

The stop is designed for rapid adjustment. The stop is disposed in the pivoting path of the pivotable adjusting lever. In one embodiment the stop is implemented with a rotatable, disk-like polygon having straight guide edges which each are at a different distance from the axis of rotation of the irregular sided polygonal stop. With this arrangement an especially effortless and rapid change-over is made possible, because one of the stop edges can be allocated to single receptacle diameter and the associated position of the labeling unit is self-adjusted in the case of a full contact between guide stop edge and the pivotable lever. In this connection it is also advantageous for a clamping device to be disposed in the pivoting area of the pivotable lever. It is possible with the clamping device to secure the adjusted and desired operational position of the unit. Such a clamping device can, for example, be such that it has a plate overlapping the pivotable lever, in which a locking screw with a handle rests.

In another embodiment the position of the upper part of the carriage is fixed by fastening a locking block to the front side of the lower part of the carriage which is provided with a slot and a bore of corresponding size for one of the rods, where the locking block can be clamped together by means of a threaded clamping screw that is provided with a handle.

In this embodiment it is not the pivotable lever itself that is clamped but the rods which support the upper part of the carriage.

As already mentioned, limiting of the pivoting path of the pivotable lever is brought about in the first embodiment by the fact that the adjustable stop is directly disposed in the pivoting path of the pivotable lever. An alternative embodiment to this one provides that limiting of the pivoting path of the pivotable lever is not done directly with an adjustable stop means in the pivoting path of the pivotable lever, but indirectly by disposing the adjustable stop in the displacement path of the rods. In this solution the displacement path of the upper part of the carriage with respect to the lower part of the carriage is directly limited in the displacement path of the two parts against each other. This solution has the advantage of positioning of the upper part of the carriage with respect to the lower part of the carriage and thus of the labeling unit with especially little clearance.

In this connection an advantageous further development of the invention is implemented with a stop designed as a rotary member which is rotatably mounted at the end of a rod and provided with adjustable stop elements. The adjustable stop elements may be screws fixed to the rotary member by means of lock nuts or counter-nuts. The use of screws as stop elements in connection with the rotary member have the advantage that such a rotary member can be used uniformly for all labeling units, because the screws can be screwed into the rotary member in any desired position and thus the most widely different receptacle shapes can be adapted. As compared with this the use of stops in the form of the previously mentioned polygon offers an adjustability limited to the number of the edges of the polygon.

If the stop has been adjusted to the unit by screwing in the screws and fixing the counter-nut, the change-over from one receptacle series to another can be effected alone by rotating the revolver-drum-like rotary member.

A stop rod may be provided at the lower part of the carriage as a counter-stop for one of the stop elements each of the rotary member.

Irrespective of the fact whether the stop is designed as a polygon or as a rotary member it is always advantageous if the stop comprises locking elements for its different stop positions. This secures the stop in the possible different positions and permits also a simple adjustment of the individual positions.

For the linking of the pivotable lever in such fashion that the upper part of the carriage can be slidingly displaced with respect to the lower part of the carriage there are several possibilities. It is provided in one embodiment that the pivotable lever is connected with the lower part of the carriage by means of a hinge and slides in a bore of the pintle which is rotatably mounted on one of the free ends of one of the rods. Another solution provides that the pivotable lever is mounted on a swivel bolt disposed on the lower part of the carriage and has an oblong hole at its end directed towards the center of the upper part of the carriage, in which a driving pin fastened to the upper part of the carriage engages.

In order to make a fine adjustment transversely to the direction of extension of the rods and the main displacement direction of the upper part of the carriage determined thereby possible, which is not needed often in practice, a further development of the invention provides that the upper part of the carriage comprises a regulating disk which is connected to the upper part of the carriage via bolts, oblong holes extending rectangularly to the direction of movement of the upper part of the carriage, a threaded spindle and a nut. With such a displacement possibility, a fine adjustment correction of the source of labels, for example, can be carried out. Since such an adjustment is necessary relatively rarely, an adjustment by means of a threaded spindle made with these features is sufficient.

Figure 1:
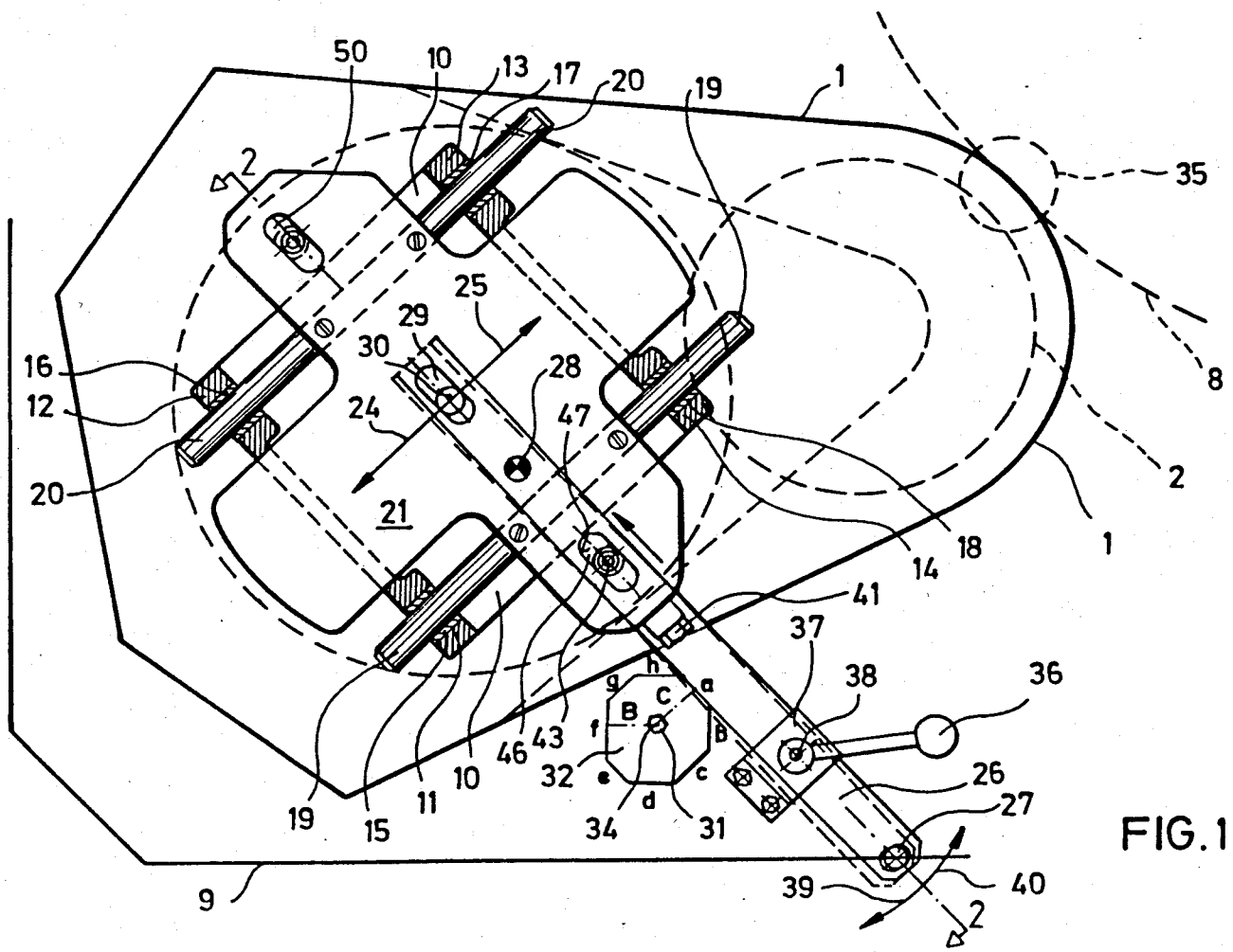
FIG. 1 shows a partial top plan view of a labeling machine in the area of the labeling unit.

Only those constructional details are illustrated in the drawings which are necessary for understanding the invention including its function. The contours of the gripper cylinder 2 and a circular segment of the bottle table 8 are represented in dashed lines in FIG. 1, to illustrate their spatial relationship to each other and to the carriage and to the pivotable lever. For these reasons in particular all driving and power transmission elements are missing.

The labeling unit 1, comprised of a conventional but not represented label box, a glue roller, a pallet revolving means and a gripper cylinder, of which only the gripper cylinder 2 and the base 3 (dashed lines in FIG. 2), are outlined, is placed with the bottom portion 4 on a regulating disk 5 and connected to the same by means of radial carriers 6 or the like, whose inwardly pointing front sides are beveled and grip flushly beneath the undercut edge 7 of the regulating disk 5 and thus center the labeling unit on the regulating disk 5.

The compound slide supporting the labeling unit is placed on the machine table 9 which provides for the rapid adjustment of the unit. The slide has a lower carriage part 10 firmly connected to the machine table 9, on whose base perpendicular lugs 11, 12, 13 and 14 with respectively aligned bores 15, 16, 17, 18 are shaped. Parallel rods 19, 20 slide in these bores 15 to 18, into which slide bushings 51 are inserted, which are firmly connected to the upper part of the carriage 21 by means of screws 22, 23, which in turn forms the foundation for the regulating disk 5 and thus for the labeling unit 1.

To actuate the upper part of the carriage 21 which can be horizontally moved in the directions of arrow 24 and 25 a pivotable lever 26 is provided which has an end-side handle 27 which is pivotable about a bolt 28 firmly anchored in the lower stationary part of the carriage 10. An oblong hole 29 is disposed in longitudinal axial fashion at its other end, which receives and guides in form-fit fashion a driving pin 30 projecting vertically downwardly from the upper part 21 of the carriage.

The pivoting movement of the lever 26 can be limited on one side by means of an irregular sided polygonal stop 32 rotatably disposed on the machine table 9 by means of a fastening screw 31. The stop is a flat plate in the form of an octagon by way of example, whose connecting straight edges a, b, c, d, e, f, g, h form guide edges 33 for a respectively close abutment with the straight edge portion of the pivotable lever 26 corresponding to this area. The guide edges corresponding to the connecting lines a to h have a different distance to the center 34 of the fastening screw 31 for example, B, C, wherefrom the different lengths of the guide edges result. Each distance of an edge a-h of the stop 32 can be rotated into parallelism and abutment with the pivotable lever 26, which is actuable in the directions of arrow 39, 40, not only in its determined angular position with respect to its initial position or zero position, but the distances make possible the working position of the gripper cylinder 2 with respect to the diameter and shape of the containers 35 to be labeled continuously conveyed on the bottle table 8 rapidly and automatically by means of a displacement of the upper part 21 of the carriage.

The adjustment position is kept during the labeling operation by means of clamping the pivotable lever 26. Clamping of the pivotable lever 26 is effected, in this example, according to FIG. 1 by a clamping lever 36, which has a threaded pin 38 disposed vertically in a threaded bore of a plate 37 overlapping the pivotable lever 26, which pin 38 presses the pivotable lever 26 against the machine table 9 in firm fashion. An alternative position of lever 26 is outlined by dashed lines in FIG. 1.

If in the case of a corresponding, determined position of use by the stop 32 and the pivotable lever 26 a slight correction for the exact seat of a neck label should be required for example, an adjusting element is provided, which permits the adjustment of the labeling unit 1 via the regulating disk 5, transversely or rectangularly to the adjustment means 24, 25 of the upper part of the carriage 21, that is, tangentially to the bottle table 8.

Figure 2:
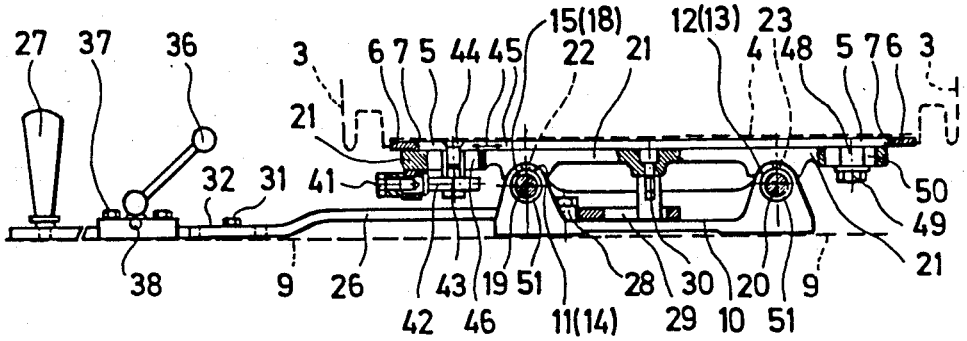
FIG. 2 shows the longitudinal section according to 2—2 of FIG. 1.

As is particularly revealed in FIG. 2 the adjustment element consists substantially of a hexagon nut head 41 having a horizontal threaded spindle 42, which is screwed into a vertical block 43. Spindle 42 can be turned by means of a tool such as a wrench, not shown. The block 43 is firmly connected to the regulating disk 5 by means of a screw 44, which follows in each case the horizontal movement of the block 43 caused by the threaded spindle 42 automatically in the directions of arrow 45 upon the actuation of the polygonal nut 41. An oblong hole 46 in the upper part of the carriage 21 makes not only an unhindered longitudinal axial displacement of the block 43 possible, but also its constant guide along the edges 47 of the oblong holes 46 in a manner as to prevent rotation.

To promote an unhindered tangential displacement of the labeling unit 1 by means of the adjustment element and in particular for its final fixing in readiness for operation, a further slide and a fastening means are provided at the periphery of the regulating disk 5 opposite of the adjustment element. A bolt 48 screwed into a threaded bore on the lower side of the regulating disk 5, at whose lower end a locking screw 49 or a locking lever may be provided passes through at this point a further oblong hole 50 aligned with the oblong hole 46, which is provided in the upper part of the carriage 21. Depending upon the direction of rotation of the locking screw 49 or the locking lever regulating disk 5 and upper part of the carriage 21 are firmly connected for the labeling process or alternatively loosened for adjustment.

The pivotable lever 26 has at the side not facing the polygonal stop 32 a wide clear pivoting area through such an angle that the labeling unit can be brought out of all engagement functions and can therefore be dismounted without any interferences. The adjustment element can be provided with a fine adjustment for the purpose of an especially exact determination of the labeling unit 1. Irrespective of the free rotatability of the stop 32, with which the working position of the labeling unit 1 is fixed via the pivotable lever 26, the stop 32 can also be fixed, for example, on the machine table with detent or resilient locking or indexing means, not shown.

Figure 3:
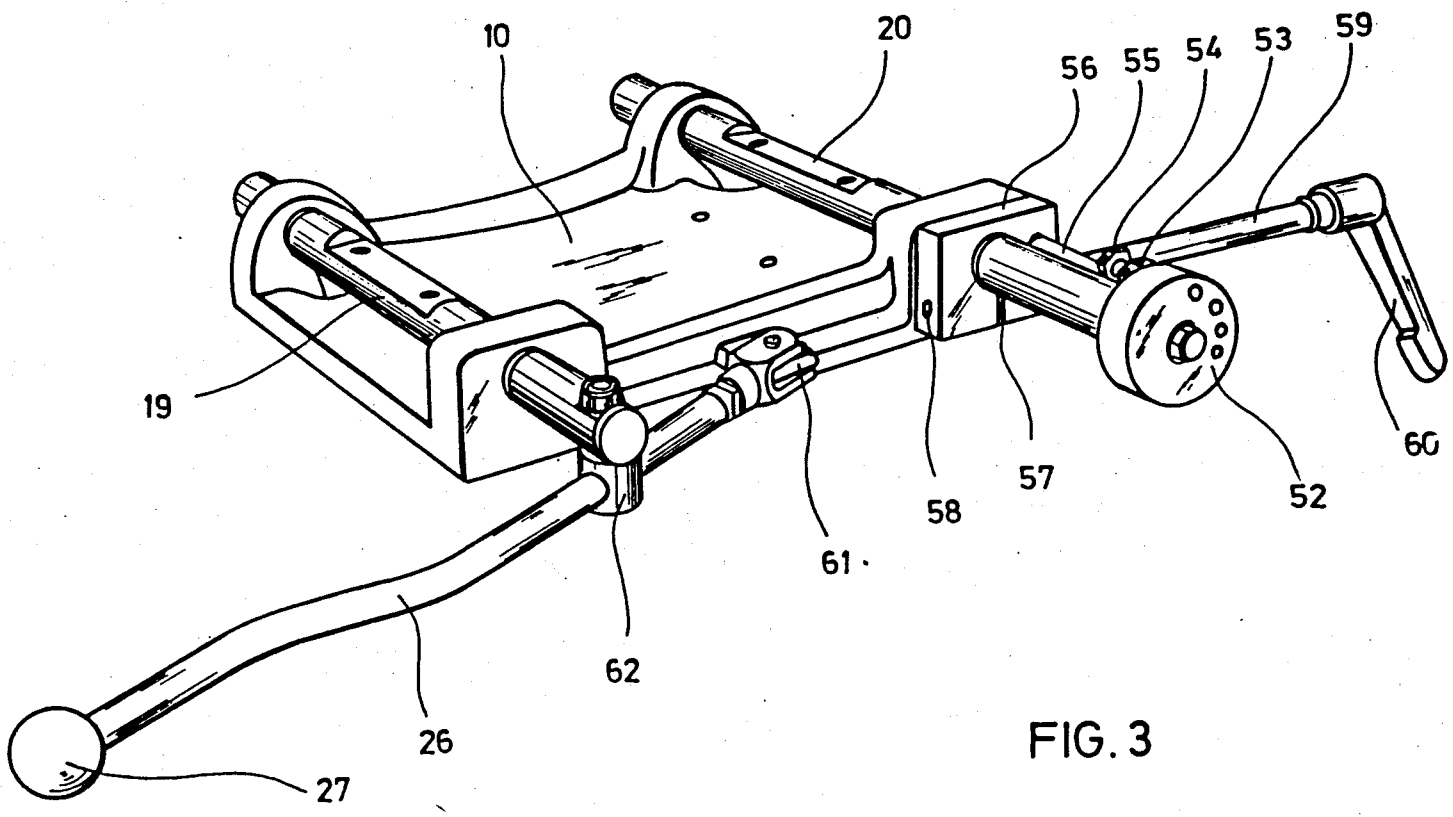
FIG. 3 shows a modified embodiment of the carriage construction.

In FIG. 3 another embodiment of a part of the compound slide according to the invention is represented. For this embodiment the same reference numerals as in FIGS. 1 and 3 are used for corresponding parts. The upper part 21 of the carriage is not shown for the purpose of a clearer representation. In this embodiment the stop does no longer act directly in the pivoting path of the pivotable lever 26, but directly on the path through which the upper part of the carriage passes as compared with the lower part of the carriage 10. The stop is comprised of a cylindrical rotary member 52 that is screwed on the free end of the rod 20 with locking positions. Several threaded holes are provided in rotary member 52 to receive hexagonal screws 53 having an associated lock nut 54. These screws 53 are adjusted to a certain position upon the assembly of the compound slide in accordance with the sample receptacles submitted by the customer and secured with the lock nut 54. The head of the screw 53 aligned with stop rod 55 is brought into abutment with the end of the stop rod 55 to stop axial shifting of the rods 19 and 20. Cylinder 52 can have a large number of threaded holes arranged in a circle for receiving stop screws so adjustment for a large number of different bottle sizes can be achieved.

In the FIG. 3 embodiment a clamp radially acting on the rod 20 is shown which consists of a locking block 56 with a bore for the rod 20, which block is mounted on the lower part of the carriage. The block has a slot 57 and a threaded bore 58 for the clamping screw 59. The threaded bore 58 is disposed vertically to the plane of the slot 57 so that the bore diameter in the locking block 56 can be narrowed by a rotational movement of the handle 60 of the clamping screw 59.

Another implementation of the pivotable shifting lever 26 shown in FIG. 1 is shown here. The pivotable lever 26 shown in FIG. 3 is connected to the lower part of the carriage 10 by means of a hinge 61. The force from the pivotable lever 26 to the upper part of the carriage is transmitted by a pintle 62 having a bore for the pivotable lever. Pintle 62 is screwed onto one end of the rod 19. Upon the actuation of the pivotable lever 26 via the handle 27 and pintle 62 can adjust itself to the angular changes of the pivotable lever 26 by rotating also.

Figure 4:
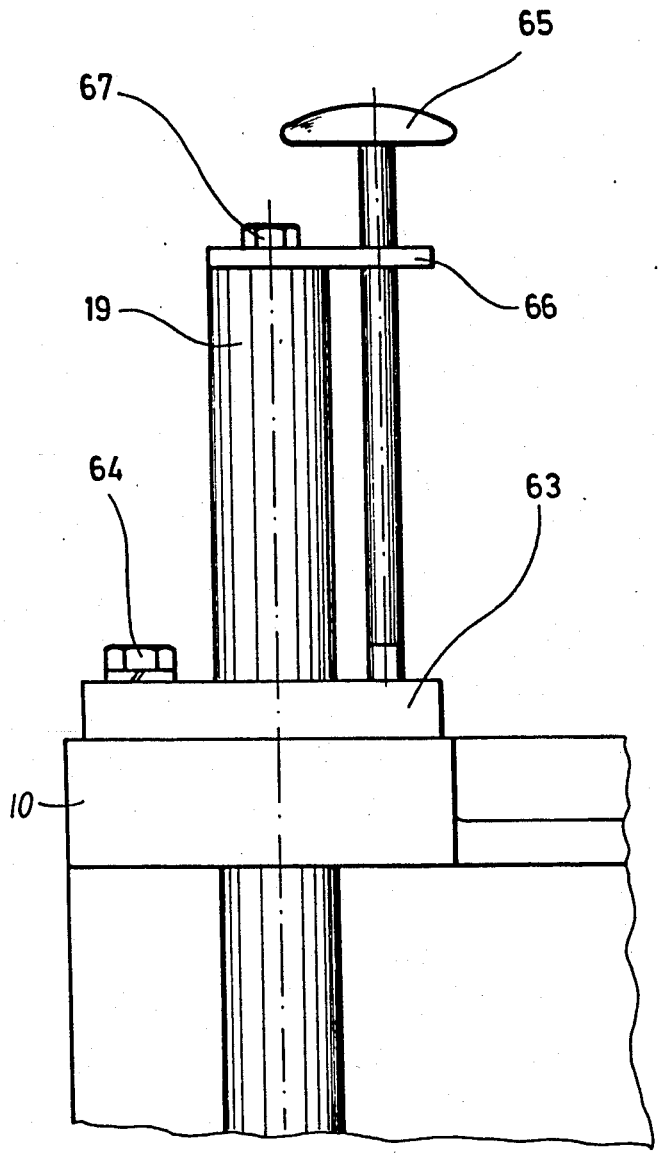
FIG. 4 shows an example of a clamping device.

Instead of the radially acting clamp a clamping variant shown in FIG. 4 can be used. In this embodiment a plate 63 equipped with a hole corresponding to the diameter of the rod 19 is connected to the front side of the lower part of the carriage 10 by means of a screw 64 and a spring washer placed underneath. On the side of the plate 63 opposite of the screw connection there is a threaded bore, into which the clamping screw 65 engages. A guide plate 66 is screwed to the end of the rod 19 by means of a screw 67. It guides the clamping screw 5 across a throughbore. If the clamping screw 65 is turned, its end meets the front side of the lower part of the carriage so that the plate 63 is lifted at one side with the result that the rod 19 is clamped or jammed due to tilting.

In all represented and described variants the receptacle change-over is effected very simply. The process of receptacle change-over takes place as follows with these new unit adjustments. First of all the clamp is loosened by actuating a handle (36 in FIG. 1, 50 in FIG. 3 and 65 in FIG. 4). Then the labeling unit can be slid back so the gripper cylinders can be exchanged. Next a new stop position is set by adjusting the stops 32 or 52. The labeling unit can then be run in up to the stop again. Finally the clamping is tightened again.

It follows from the aforementioned description that the invention makes a receptacle change-over possible which can be carried out extremely simply and rapidly.

I claim:

1. An adjustable device for adapting a labeling machine to apply labels to containers of various types, said device comprising:

a compound slide including a lower carriage fixed to said machine and an upper carriage mounted on said lower carriage for moving thereon and for supporting at least one element involved in applying labels to said containers, lever means mounted for pivoting relative to said machine and operatively connected to said upper carriage and swingable to facilitate shifting said upper carriage to accommodate application of labels to containers of different types, guide rods for said upper carriage to move on said lower carriage, said guide rods being fastened in parallelism to said upper carriage, bearing means in said lower carriage through which said guide rods extend and slide, adjustable stop means arranged to set the limit to which said upper carriage is permitted to move toward said containers in response to pivoting said lever means, said stop means including a member mounted on a free end of one of said guide rods for rotation about the axis of said one of said guide rods, and a stop element mounted fixedly to said lower carriage, and a plurality of rod-like elements arranged in an arc on said member around the axis of said one of said guide rods, said rod-like elements being adjustable axially and rotatable with said member selectively into alignment with said fixedly mounted stop element.

2. An adjustable device for adapting a labeling machine to apply labels to containers of various types, said device comprising:

a compound slide including a lower carriage fixed to said machine and an upper carriage mounted on said lower carriage for moving thereon and for supporting at least one element involved in applying labels to said containers, lever means mounted for pivoting relative to said machine and operatively connected to said upper carriage and swingable to facilitate shifting said upper carriage to accommodate application of labels to containers of different types, adjustable stop means arranged to set the limit to which said upper carriage is permitted to move toward said conatiners in response to pivoting said lever means, a regulating disk fastened to said upper carriage, a spindle having a thread and means projecting from said upper carriage for supporting said spindle for rotation, and an element fastened to said regulating disk and having a threaded hole into which said threaded spindle is engaged so that when said spindle is turned to advance and retract in said threaded hole, said disk will be driven to move on said upper carriage substantially perpendicularly to the direction said upper carriage moves relative to said lower carriage.

* * * * *